US005983574A

United States Patent [19]

Holztrager

[11] Patent Number: 5,983,574

[45] Date of Patent: Nov. 16, 1999

[54] MERCHANDISE DISPLAY PANEL

[75] Inventor: William J. Holztrager, Chilhowie, Va.

[73] Assignee: Showall, Inc., Chilhowie, Va.

[21] Appl. No.: 08/743,624

[22] Filed: Nov. 4, 1996

[51] Int. Cl.[6] ..... E04B 2/74; A47F 5/08

[52] U.S. Cl. ..... 52/36.5; 52/578; 52/588.1; 52/377; 211/87.01; 211/94.01

[58] Field of Search ..... 52/578, 377, 36.4, 52/36.5, 36.1, 588.1; 211/87.01, 94.01, 40, 46

[56] References Cited

U.S. PATENT DOCUMENTS

| | | | |
|---|---|---|---|
| 2,872,712 | 2/1959 | Brown et al. | 52/578 |
| 3,664,906 | 5/1970 | Hartig . | |
| 4,323,163 | 4/1982 | Johns | 52/36.5 X |
| 4,391,375 | 7/1983 | Joyce . | |
| 4,572,381 | 2/1986 | Breakey et al. . | |
| 4,591,058 | 5/1986 | Amstutz et al. . | |
| 4,629,076 | 12/1986 | Amstutz et al. . | |
| 4,752,010 | 6/1988 | Holztrager . | |
| 4,944,416 | 7/1990 | Petersen et al. . | |
| 4,961,295 | 10/1990 | Kosch, Sr. et al. | 52/36.5 |
| 5,101,986 | 4/1992 | Holztrager | 211/94.01 X |
| 5,125,193 | 6/1992 | Beaulieu . | |
| 5,259,517 | 11/1993 | Pancoe | 211/46 X |
| 5,337,903 | 8/1994 | Wolcovitch et al. | 211/87.01 X |
| 5,341,942 | 8/1994 | James, Jr. | 211/94.01 X |
| 5,450,694 | 9/1995 | Goranson et al. . | |

*Primary Examiner*—Carl D. Friedman
*Assistant Examiner*—Winnie S. Yip
*Attorney, Agent, or Firm*—Shlesinger, Arkwright & Garvey, LLP

[57] ABSTRACT

A merchandise display panel comprises a plurality of profiles including outer edges, the profiles being arranged in a stacked edge-to-edge configuration; and a plurality of stiffeners glued to the back surfaces of the profiles across the edges between adjacent profiles.

12 Claims, 2 Drawing Sheets

FIG. 1
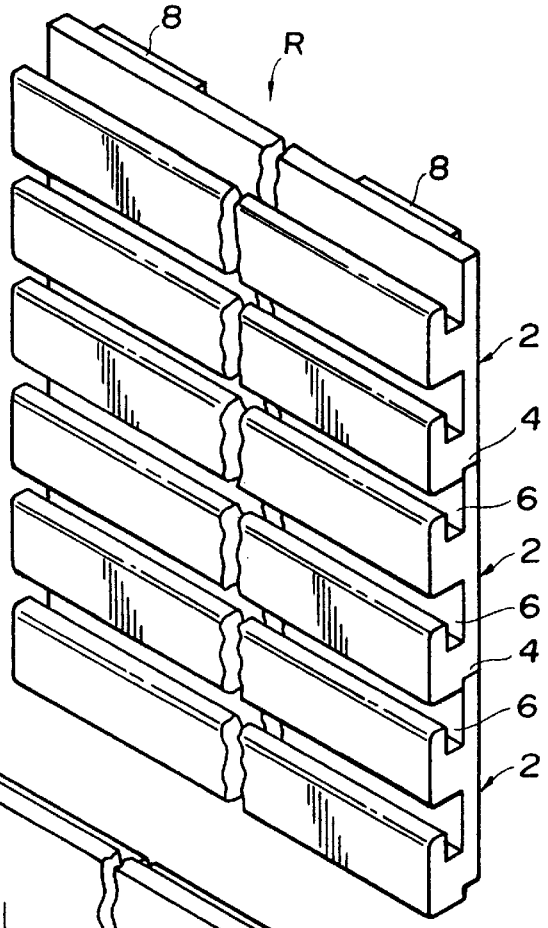
FIG. 3
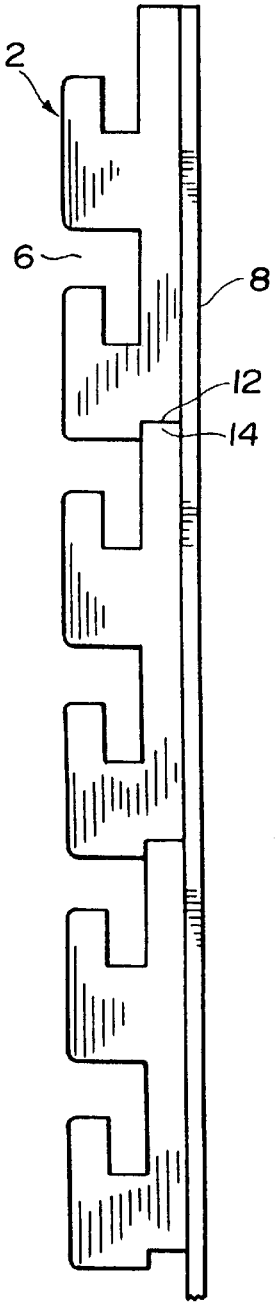
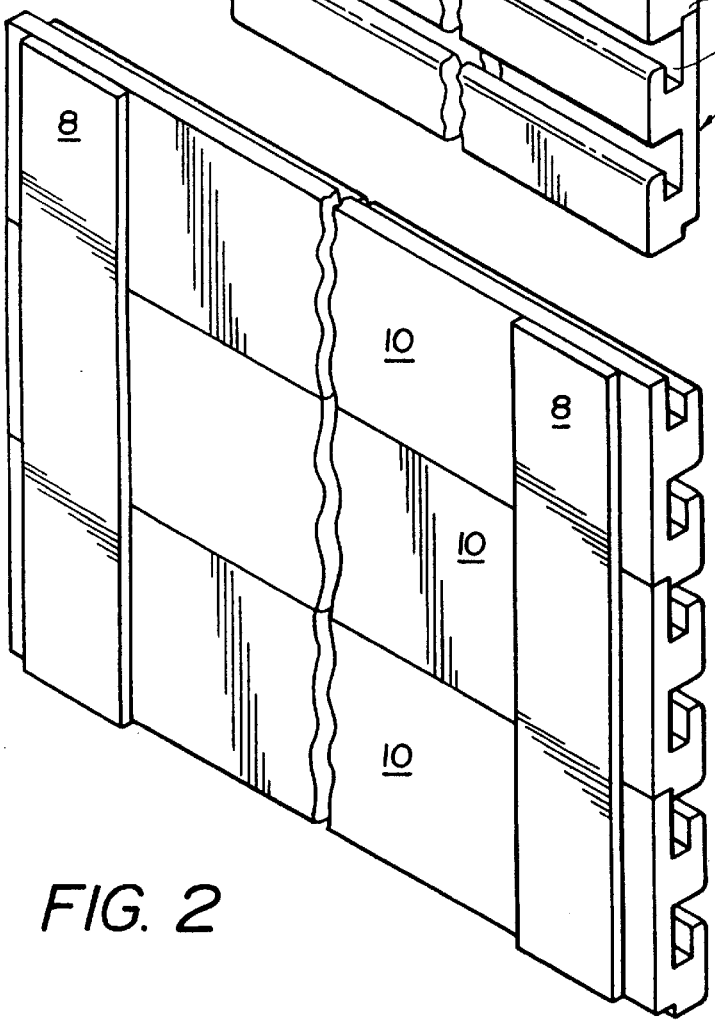
FIG. 2

MERCHANDISE DISPLAY PANEL

FIELD OF THE INVENTION

The present invention relates generally to a merchandise display panel for displaying merchandise in retail stores, trade shows or the like, and particularly to a slot wall construction utilizing lightweight and relatively fire resistant materials.

BACKGROUND OF THE INVENTION

The National Fire Protection Association (NFPA) is requiring that all materials used in the construction of slat walls be of Class A fire rating. Although present materials used in slot wall construction include fire-resistant profiles, wood products such as plywood, fiberboard and the like are still used as backerboards, generally making the resulting assembly Class C. Additionally, the use of co-extensive backerboards make the assembly relatively heavy, incurring penalties in freight cost in shipping to the job site and labor cost in installing the panels.

There is therefore a need for a merchandise display panel that is relatively fire resistant that meets the NFPA fire safety code and a lightweight assembly that would be relatively cheaper to handle and ship.

OBJECTS AND SUMMARY OF THE INVENTION

It is an object of the present invention to provide a merchandise display panel that meets NFPA fire safety requirements for construction of display walls.

It is another object of the present invention to provide a merchandise display panel that is relatively lightweight as compared to prior art construction.

It is still another object of the present invention to provide a merchandise display panel that utilizes standard slat wall hardware.

It is another object of the present invention to provide a merchandise display panel that is made in convenient sizes for one person to handle.

It is another object of the present invention to provide a merchandise display panel that is relatively inexpensive to manufacture and relatively less time consuming to install at the job site.

It is another object of the present invention to provide a merchandise display panel that is modular in construction such that multiple units of the panel can be secured together to form any desired size.

In summary, the present invention provides a merchandise display panel comprising a plurality of profiles including outer edges, the profiles being arranged in a stacked edge-to-edge configuration; and a plurality of stiffeners glued to the back surfaces of the profiles across the edges between adjacent profiles.

The present invention also provides a method for constructing a merchandise display panel, comprising the steps of providing a plurality of profiles; arranging the profiles parallel to each other; and gluing a plurality of stiffeners to the back of the profiles.

These and other objects of the present invention will become apparent from the following detailed description.

BRIEF DESCRIPTIONS OF THE DRAWINGS

FIG. 1 is a fragmentary front perspective view of a display panel made in accordance with the present invention.

FIG. 2 is a fragmentary rear perspective view of the display panel of FIG. 1.

FIG. 3 is the side elevational view of FIG. 1.

DETAILED DESCRIPTION OF THE INVENTION

Figure 4:
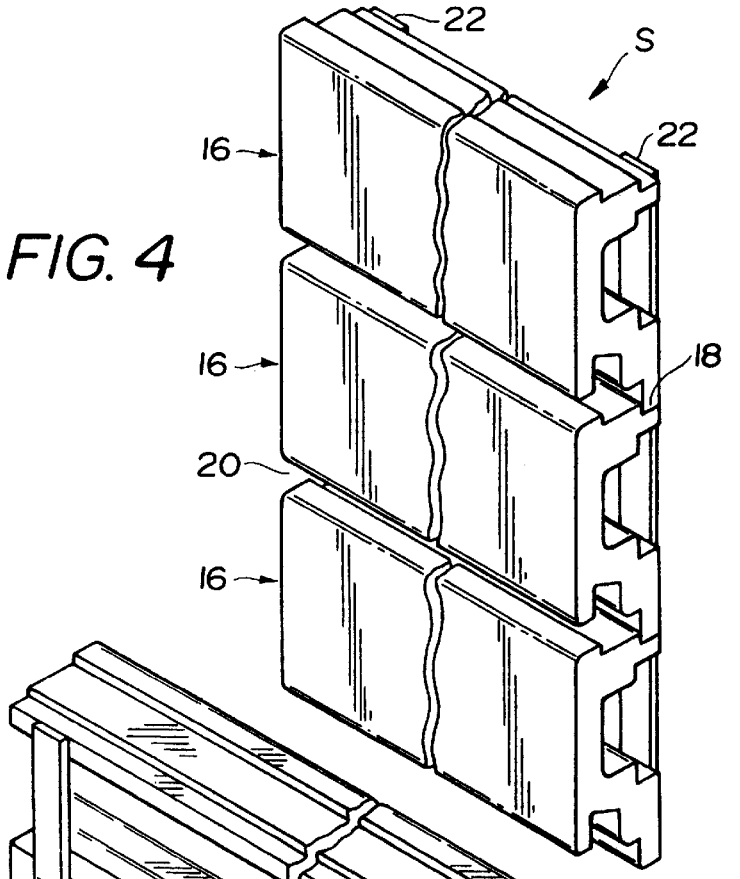
FIG. 4 is a fragmentary front perspective view of another embodiment of a display panel made in accordance with the present invention.
Figure 5:
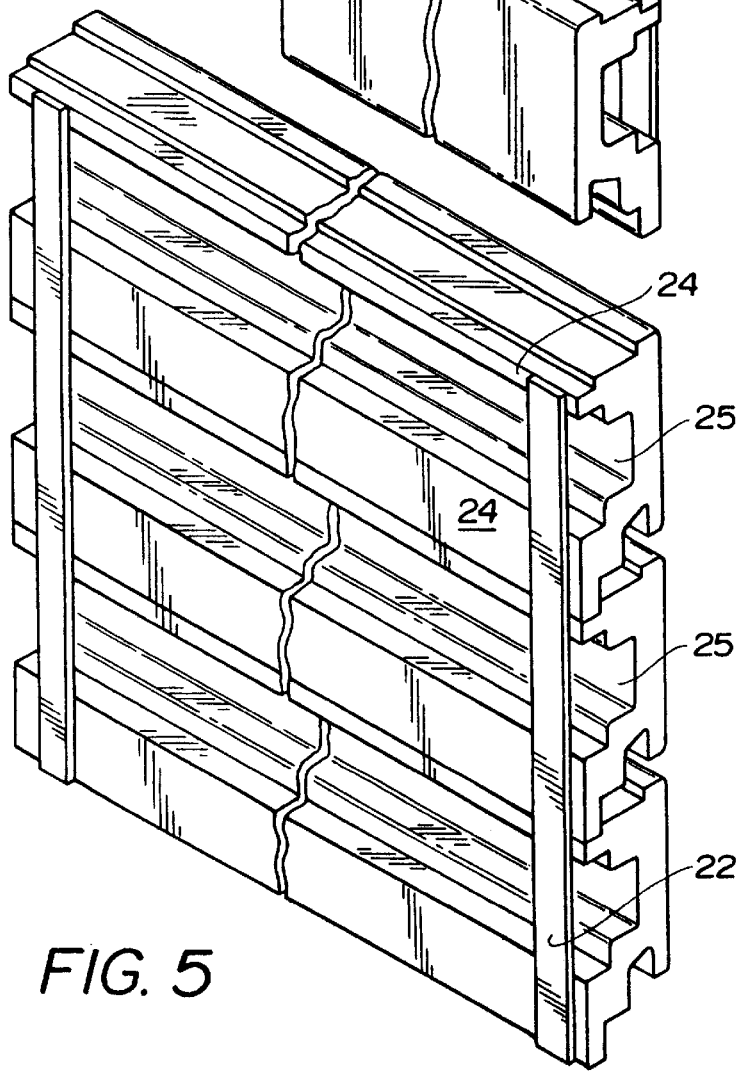
FIG. 5 is a fragmentary rear perspective of FIG. 4.

A merchandise display panel R made in accordance with the present invention is disclosed in FIG. 1. The panel R includes a plurality of profiles 2 that are glued edge-to-edge, as generally indicated at 4. The profiles 2 are arranged in parallel configuration, thereby to form horizontal grooves 6 that are adapted to support shelves (not shown) or other supporting members (not shown) on which merchandise can be placed for display.

A plurality of slats or stiffeners 8 are glued to the back surfaces 10 of the profiles, as best shown in FIG. 2. The stiffeners 8 are preferably disposed transversely to the longitudinal axes of the profiles 2 and are spaced apart approximately 16" on-center. Each stiffener 8 is in strip form, approximately 1" wide by ⅛" thick. The stiffeners 8 advantageously provide reinforcement to the panel R and eliminates the use of a solid backboard, thereby substantially reducing the weight of the panel. The stiffeners are advantageously made of fire resistant plastic, such as the same material of which the profiles made.

Each profile 2 has a slot 12 that receives an edge portion 14 of the adjacent profile to provide an interlocking joint between adjacent profiles, as best shown in FIG. 3. Each stiffener 8 is secured to every adjacent profiles across the interlocking edges, thereby adding to the structural integrity of the assembly.

The profiles 2 can be of any specific cross-sectional configuration, depending on the application for the panel R. The profiles 2 are preferably constructed of Celuka polyvinylchloride or other suitable fire resistant material.

Other profiles can be used to manufacture the display panel. Examples of other profiles are disclosed in U.S. Pat. Nos. 5,485,934 and 4,752,010, which are incorporated herein by reference.

The panel R can be made into different sizes, such as 2 ft. wide by 4 ft. high, 4 ft. wide by 2 ft. high, and 8 ft. wide by 1 ft. high, each size being adapted to be advantageously handled by a single person. Several such panels may be joined together by edge gluing one panel to the next panel along the outermost slot 12 of one panel to the outermost edge portion 14 of the next panel. In this manner, a larger size merchandise display panel can constructed at the job site from smaller size panels that are relatively easy to handle. Typically one or two people at the most would be needed to cover an existing wall in a retail store using several of the panels R.

Lower freight cost is advantageously realized through the elimination of solid backerboards, made possible by the use of the stiffeners 8.

The panel R can be secured to an existing structure such as drywall, wood or metal studs, etc., with screws or other standard connectors. The panel R can also be made into a box structure that would be freestanding such as disclosed in U.S. Pat. No. 5,485,934.

Another embodiment of a display panel S made in accordance with the present invention is disclosed in FIG. 4. The panel S comprises a plurality of profiles 16 that are glued edge to edge at 18 to form an assembly that makes up the panel. The profiles 16 are disposed parallel to each other to create grooves 20 between adjacent profiles that are adapted to support shelves (not shown) or other supporting members (not shown) on which merchandise is placed for display.

A plurality of slats or stiffeners 22 are glued to back surfaces 24 of the profiles to advantageously reinforce the panel. Although the profiles 16 have deep slots 25, the back surfaces 24 are advantageously coplanar to provide sufficient gluing surfaces for the stiffeners.

Figure 6:
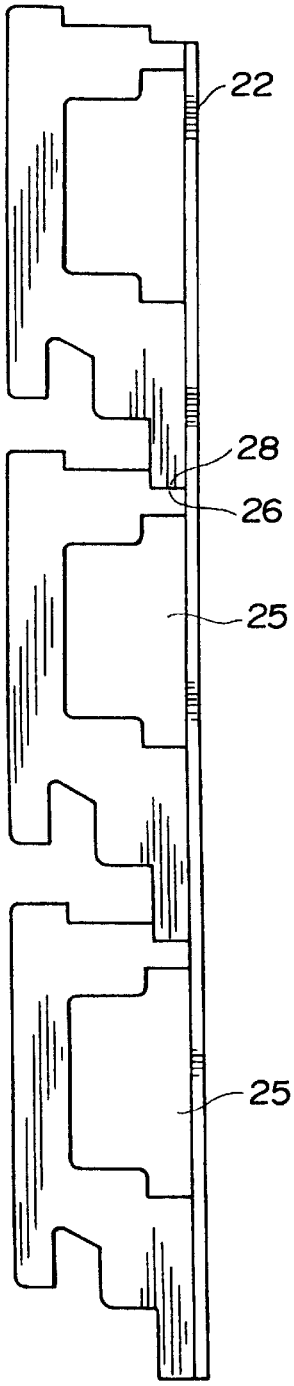
FIG. 6 is a side elevational view of FIG. 4.

Each profile includes a recess or slot 26 which is adapted to receive an edge portion 28 in a cooperating manner such that a profile is interlocked with the adjacent profile, as best shown in FIG. 6.

The display panel S can made in different sizes, each size being small enough to be handled by one or two persons, thereby advantageously saving in labor cost in putting up a display wall at the job site. Examples of sizes are 2 ft. wide by 4 ft. high, 4 ft. wide by 2 ft. high, and 8 ft. wide by 2 ft. high.

A person of ordinary skill in the art will understand that the panel of the present invention will be sturdy, rigid, self-supporting and lightweight because of the glued interlocking edges and the use of the stiffeners 8.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A merchandise display panel, comprising:

a) a plurality of profiles including upper and lower out on edges, and back surfaces, said profiles being arranged in a stacked upper edge-to-lower edge configuration such that said display panel is closed at its back portion;

b) each of said profiles having a front surface extending outwardly from said back portion and substantially parallel to said back surfaces such that said display panel includes a plurality of said front surfaces separated from one another by respective horizontal grooves, said grooves communicating with respective said front surfaces and configured to operably secure a merchandise for display;

c) a plurality of stiffeners in the form of strips glued to said back surfaces across said edges of adjacent profiles; and d) one of said upper and lower outer edges including a slot and the other of said upper and lower outer edges being received within said slot.

2. A merchandise display panel as in claim 1, wherein:

a) said stiffeners and profiles are longitudinal; and b) said stiffeners are disposed transversely to the longitudinal axes of said profiles.

3. A merchandise display panel as in claim 1, wherein:

a) said stiffeners are plastic strips about ⅛" thick each.

4. A merchandise display panel as in claim 1, wherein:

a) said stiffeners are separated from each other approximately 16" on-center of said stiffeners.

5. A merchandise display panel as in claim 1, wherein:

a) each of said profiles includes a pair of J-shaped cross-sections.

6. A merchandise display panel as in claim 1, wherein:

a) each of said profiles includes a slot at its rear portion.

7. A display wall assembly, comprising:

a) a plurality of profiles arranged in a parallel configuration, said profiles having back surfaces;

b) each of said profiles having a front surface extending outwardly from and substantially parallel to said back surfaces such that said display panel includes a plurality of said front surfaces separated from one another by respective horizontal grooves, said grooves communicating with respective said front surfaces and configured to operably secure a merchandise for display;

c) a plurality of stiffeners in the form of strips glued to said back surfaces between adjacent profiles;

d) said profiles having upper and lower outer edges;

e) each upper edge is glued to a corresponding engaging lower edge of an adjacent profile; and f) one of said upper and lower outer edges including a slot and the other of said upper and lower outer edges being received within said slot.

8. A display wall assembly as in claim 7, wherein:

a) said stiffeners and profiles are longitudinal; and b) said stiffeners are disposed transversely to the longitudinal axes of said profiles.

9. A method for constructing a merchandise display panel, comprising the steps of:

a) providing a plurality of profiles, said profiles having outer upper and lower edges and back surfaces;

b) providing a slot in one of said upper and lower edges;

c) arranging the profiles parallel to each other in a stacked upper edge-to-lower edge configuration such that a back portion of the display panel is closed and one of the upper and lower edges is received within the slot, each of said profiles having a front surface extending outwardly from said back portion and substantially parallel to said back surfaces such that said display panel includes a plurality of said front surfaces separated from one another by respective horizontal grooves, said grooves communicating with respective said front surfaces and configured to operably secure a merchandise for display; and d) gluing a plurality of stiffeners in the form of strips to the back of the profiles.

10. A method as in claim 9, wherein said gluing the plurality of stiffeners include positioning the stiffeners transversely to the longitudinal axes of the profiles.

11. A method as in claim 9, wherein said gluing the plurality of stiffeners include spacing apart the stiffeners from each other.

12. A method as in claim 9, and further comprising the step of gluing the profiles edge-to-edge.

* * * * *